US006341643B1

(12) United States Patent
Osakabe

(10) Patent No.: US 6,341,643 B1
(45) Date of Patent: Jan. 29, 2002

(54) CROSSFLOW FAN

(75) Inventor: Hiroyuki Osakabe, Chita-gun (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/563,133

(22) Filed: May 2, 2000

(30) Foreign Application Priority Data

May 10, 1999 (JP) ..... 11-127980

(51) Int. Cl.[7] ..... F28F 1/00

(52) U.S. Cl. ..... 165/41; 165/42; 165/122; 454/156; 454/121; 62/244

(58) Field of Search ..... 165/41, 42, 43, 165/51, 122; 454/156, 121; 415/53.1, 53.2, 53.3; 62/244

(56) References Cited

U.S. PATENT DOCUMENTS 3,807,495 A * 4/1974 Skarecky ..... 165/122
4,616,693 A * 10/1986 Dietzsch et al. ..... 165/41
5,415,226 A * 5/1995 Koo ..... 165/135
5,918,666 A * 7/1999 Chin ..... 165/122
5,964,658 A * 10/1999 Aizawa ..... 454/156
5,967,224 A * 10/1999 Iwanaga et al. ..... 165/42

FOREIGN PATENT DOCUMENTS

JP 04366332 A * 12/1992 ..... 165/122
JP A-8-126125 * 5/1996

* cited by examiner

*Primary Examiner*—Ira S. Lazarus
*Assistant Examiner*—Terrell McKinnon
(74) *Attorney, Agent, or Firm*—Harness, Dickey & Pierce, PLC

(57) ABSTRACT

A cross-flow fan is provided in which air movement is increased without increasing the power of the motor. Opening portions for ventilation are bored wall surfaces forming a stabilizer in the casing of a cooling fan. These bores are at positions separated from the tongue portion by predetermined distances. When a bladed wheel is rotated by a motor, air is sucked from the front side of a core portion through the core portion and into the inside of the casing. The cooling fan generates, in the inside of the casing, a simple flow passing through the bladed wheel to a discharge port. This flow has a circulation flow (swirl) circulating within the bladed wheel.

10 Claims, 10 Drawing Sheets

CROSSFLOW FAN

CROSS-REFERENCE TO RELATED APPLICATION

The present invention is related to Japanese patent application No. Hei. 11-127980, filed May 10, 1999, the contents of which are incorporated herein by reference.

FIELD OF THE INVENTION

The present invention generally relates to a cross-flow fan, and more particularly, to a cross-flow fan, which provides for reduced ventilation resistance.

BACKGROUND OF THE INVENTION

Presently, there is a conventional technique (Japanese Patent Application Laid-Open No. 8-126125) which uses a cross-flow fan as a cooling fan for a heat exchanger mounted in a vehicle. As shown in FIG. 12, this technique uses a heat exchanger 100 disposed in the path of run wind. A cross-flow fan 110 is disposed toward the vehicle's rear side with respect to the heat exchanger 100, so that air passing through the heat exchanger 100 flows from the front side of the vehicle to the rear side. As such, it is possible to cool the heat exchanger 100 by using the run wind generated by movement of the vehicle, in addition to the cooling wind generated by the cross-flow fan 110.

However, when heat exchanger 100 is cooled by using the run wind, the run wind passing through the heat exchanger 100 passes through the inside of a casing 120 of the cross-flow fan 110. A bladed wheel 130 is contained in the inside of casing 120, which results in large ventilation resistance. Therefore, it is difficult for the run wind to pass through, thereby resulting in ineffective use of the run wind. The present invention was developed in light of these drawbacks.

SUMMARY OF THE INVENTION

It is therefore an object of the present invention to provide a cross-flow fan, which increases the amount of wind sent without increasing the power of the motor.

According to a first aspect of the invention, a cross-flow fan for ventilating a heat exchanger sucks air into a casing through the heat exchanger. An opening portion for ventilation is bored into a wall surface of the casing. As a result, ventilation resistance in the casing is decreased. Therefore, air movement therethrough is increased.

According to a second aspect of the invention, the casing includes a partition for partitioning the air passage into an intake side and a discharge side. A tongue portion is positioned close to the outer periphery of the bladed wheel as an apex. Also, an opening is bored in the wall surface forming the partition.

According to a third aspect of the invention, the partition has roughly a mountain shape formed by the wall surface at the intake side with respect to the tongue portion and the wall surface at the discharge side. The opening is bored in either the wall surface at the intake side or the wall surface at the discharge side. Or, the opening is bored into both surfaces.

According to a fourth aspect of the invention, the openings are bored into both the wall surface at the intake side and the wall surface at the discharge side thereby forming the partition. The respective distances between the two openings and the center of a swirl generated inside of the casing at the time of rotation of the bladed wheel are equal to each other.

According to a fifth aspect of the invention, the cross-flow fan is disposed at a vehicle's rear side with respect to the heat exchanger mounted in a vehicle, so that a run wind passing through the heat exchanger can be introduced into the inside of the casing. In this case, since the run wind can pass through the inside and the outside of the casing through the opening portions bored in the casing, it becomes easy for the run wind to escape from the inside of the casing, and an increase of an amount of run wind can be expected.

Further areas of applicability of the present invention will become apparent from the detailed description provided hereinafter. It should be understood that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
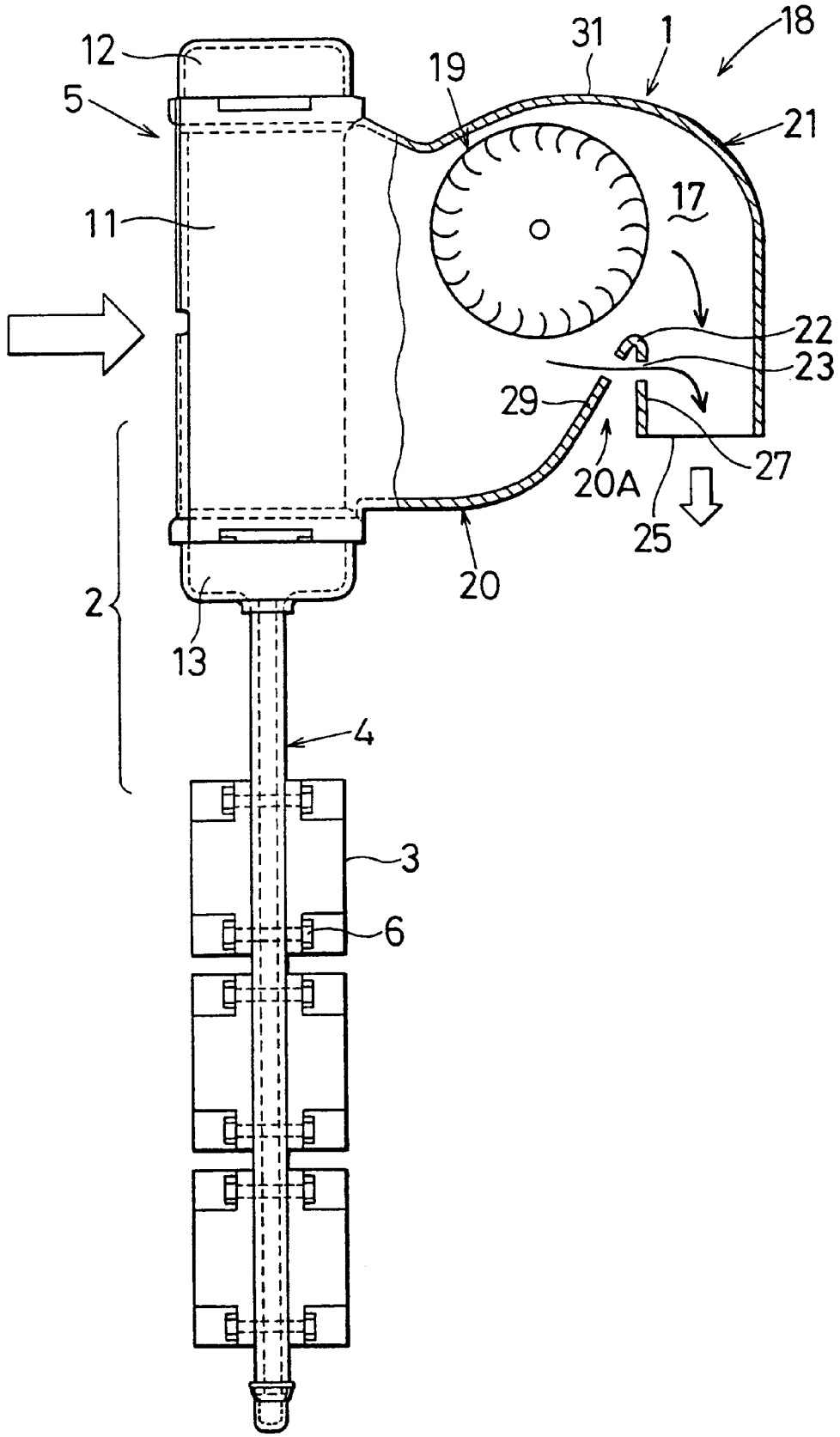
FIG. 1 is a side cross-sectional view of a cross-flow fan according to a first embodiment of the present invention.
Figure 2:
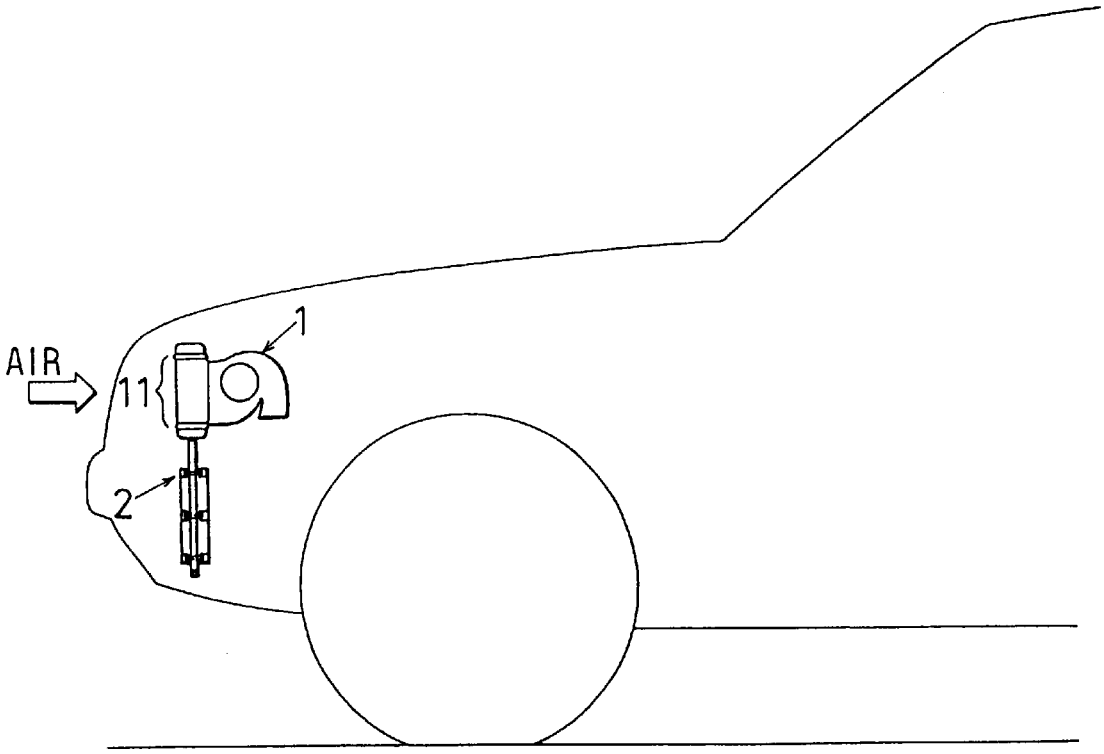
FIG. 2 is an environmental view showing cross-flow fan mounted to a vehicle according to the present invention.

Referring to FIG. 1 and 2, a cross-flow fan according to the present invention is shown and described. In FIG. 2, A cross-flow fan (hereinafter referred to as cooling fan 1) is illustrated as a cooling means for a boiling cooling apparatus 2 mounted in a vehicle.

Figure 4:
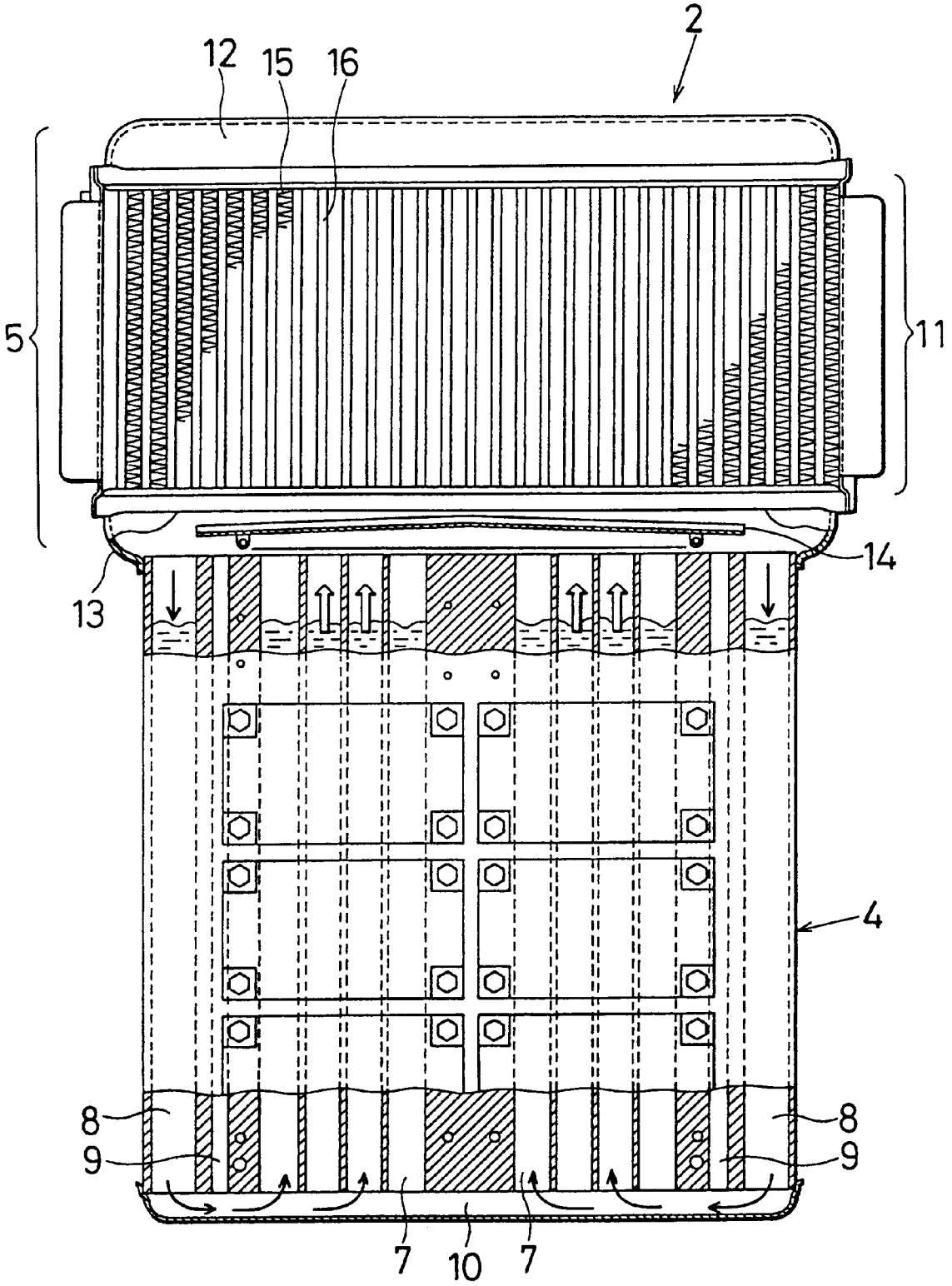
FIG. 4 is a front cross-sectional view of a boiling and cooling apparatus for a cross-flow fan according to the present invention.

The boiling and cooling apparatus 2 cools heat generating units 3 by repeated boiling and condensation of a refrigerant. As shown in FIG. 4, boiling and cooling apparatus 2 includes a refrigerant tank 4 for storing a liquid refrigerant and a radiator 5 attached to the upper portion of the refrigerant tank 4. These items are manufactured by integrated soldering.

The heat generating units 3 are, for example, IGBT modules of an inverter circuit of an electric car. As such, heat generating units 3 are brought into close contact with and affixed to both surfaces of the refrigerant tank 4 by bolts 6 or the like.

The refrigerant tank 4 has thin walls as compared to its width. Refrigerant tank 4 includes a refrigerating chamber 7, a liquid return passage 8, a heat insulating passage 9, and a connecting passage 10. Refrigerant chamber 7 is formed in the region where the heat generating unit 3 is attached, and is divided into a plurality of passages.

Liquid return passages 8 allow condensed liquid, cooled and liquefied by the radiator 5, to flow. Liquid return passages 8 are provided at both sides of the refrigerant tank 4. Heat insulating passages 9 insulate a portion between the refrigerant chamber 7 and the liquid return passage 8. These passages are provided between the refrigerant chamber 7 and the liquid return passage 8.

The connecting passage 10 is a passage for supplying the condensed liquid that has flowed into the liquid return passage 8 to the refrigerant chamber 7, and is provided at the lower end portion of the refrigerant tank 4, and mutually communicates with the liquid return passage 8, the refrigerant chamber 7, and the heat insulating passage 9.

Radiator 5 has a core portion 11, an upper tank 12, and a lower tank 13. Refrigerant flow control plate 14 is disposed in the inside of the lower tank 13. Core portion 11 has a plurality of radiating tubes 16 provided side by side between radiating fins 15.

Upper tank 12 is connected with the upper end of each of the radiating tubes 16. Likewise, each of the respective radiating tubes 16 communicate with each other in the upper tank 12.

Lower tank 13 is connected with the lower end of each of the radiating tubes 16. Likewise, the respective radiating tubes 16 communicate with each other in the lower tank 13.

The refrigerant flow control plate 14 prevents condensed liquid, liquefied in the radiating tube 16, from directly dropping into the refrigerant chamber 7. Refrigerant flow control plate 14 hangs over the refrigerant chamber 7 and the heat insulating passage 9 which opens into the lower tank 13.

Referring to FIG. 1, the cooling fan 1 includes a casing 18 which forms an air passage 17, a bladed wheel 19 contained in casing 18, a motor (not shown) for rotating and driving the bladed wheel 19. Cooling fan 1 is seated at a vehicle's rear side with respect to the core portion 11 of the radiator 5 (see FIG. 2).

Casing 18 forms an air passage having an inside wall surface 20 with a stabilizer 20A (partition portion of the invention), an outside wall surface 21 having a scroll portion 31, and two side wall surfaces (not shown) covering both outsides of the bladed wheel 19 in the axial direction. An intake port (not shown) of the air passage 17 is attached opposite to the core 11. A discharge port 25 opens substantially downward.

The stabilizer 20A provided on the inside wall surface 20 is formed to be roughly mountain-shaped. Stabilizer 20A further has a tongue portion 22 close to the outer periphery of bladed wheel 19 as an apex. Tongue portion 22 divides the air passage 17 in the casing 18 into an intake side and a discharge side.

Figure 3A:
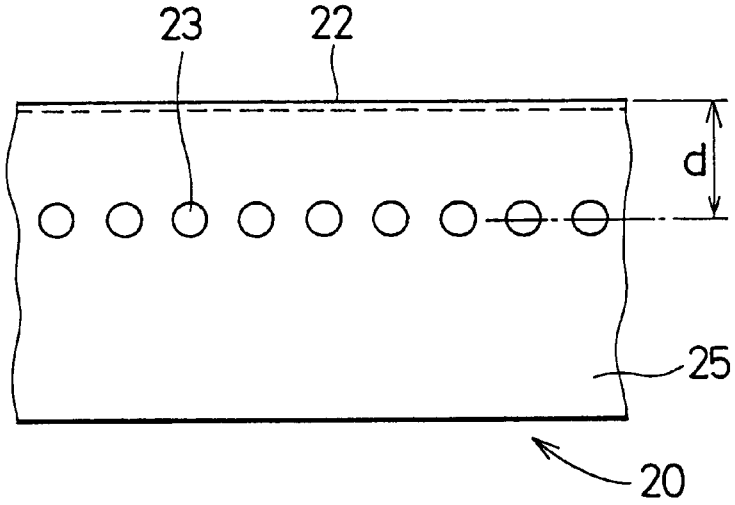
FIG. 3A is a partial cross-sectional view of a casing for a cross-flow fan according to the present invention.
Figure 3B:
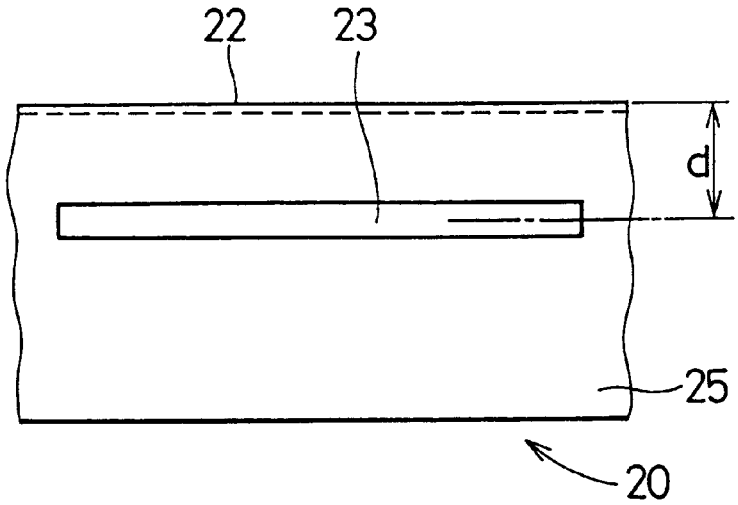
FIG. 3B is a partial cross-sectional view of a casing for a cross-flow fan according to the present invention.

Stabilizer 20A is formed of wall surface 29 at the intake side with respect to tongue portion 22 and wall surface 27 at the discharge side. Wall surfaces 29 and 27 have opening portions 23 for ventilation. These opening portions 23 are respectively bored at a position separated from the tongue portion 22 by a predetermined distance d. Opening portions 22 may be provided, for example, as shown in FIG. 3A. Here, opening portions 22 comprise a plurality of small holes provided along the longitudinal direction of the inside wall surface 20. Alternatively, as shown in FIG. 3B, opening portions 22 comprise a slit-like opening portion provided along the longitudinal direction of the inside wall surface 20.

Figure 5:
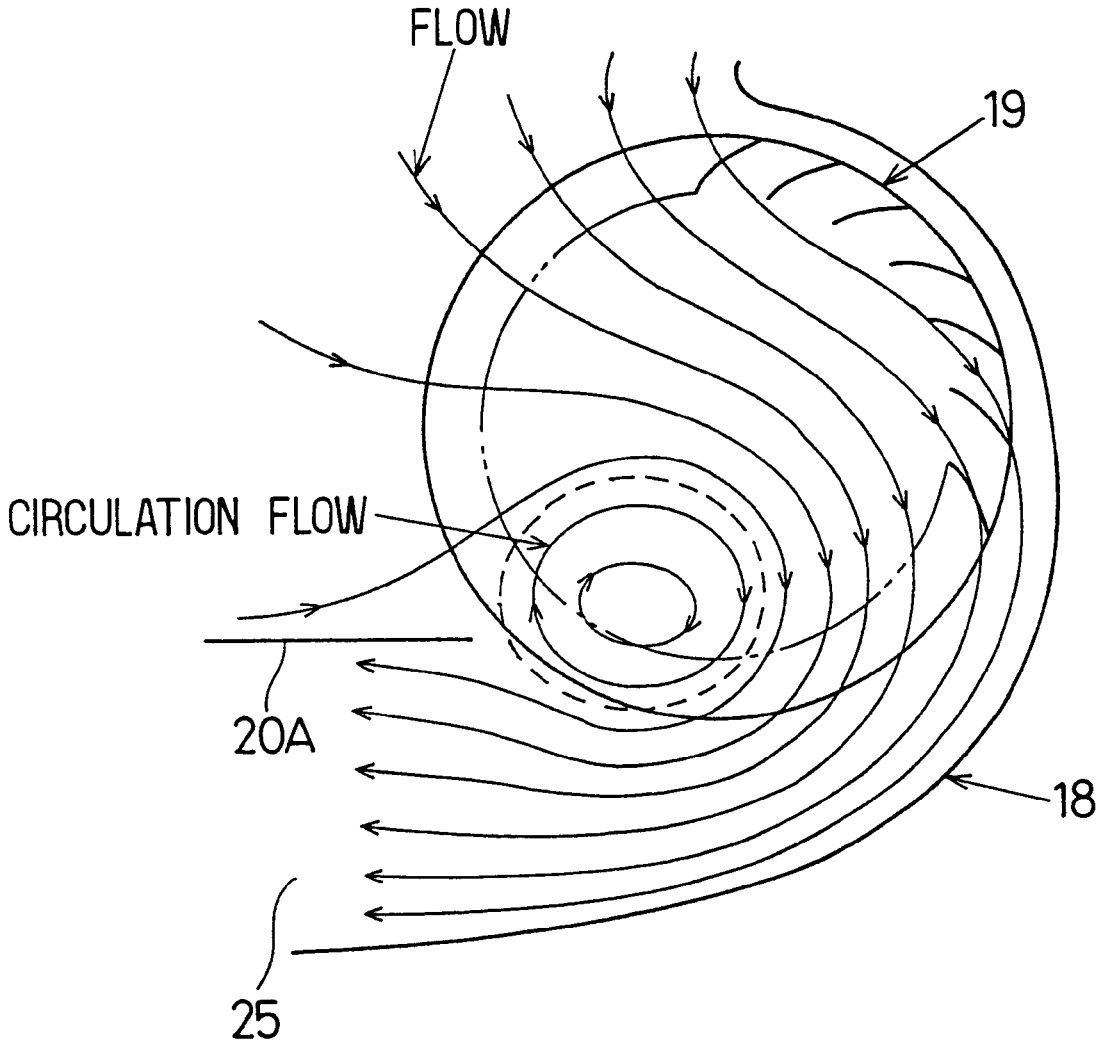
FIG. 5 is a diagrammatical view of a casing for a cross-flow fan according to the present invention.

When bladed wheel 19 is rotated and driven by a motor, air is sucked into the inside of the casing 18 from the front side of the core 11 of the radiator 5 and moves through the core portion 11. As shown in FIG. 5, the cooling fan 1 generates, inside casing 18, a simple flow which passes through bladed wheel 19 and travels toward the discharge port 25, thereby causing a circulation flow (swirl) which circulates inside bladed wheel 19.

Here, where opening portions 23 are bored in the wall surfaces which form the foregoing stabilizer 20A, the opening portion 23 is preferably bored in the wall surface 29 at the intake side with respect to the tongue portion 22. Also, opening portion 23 is preferably bored in wall surface 27 at the discharge side. These portions are provided at positions respectively separated from the center of the swirl (circulation flow) by substantially equal distances.

The operation of the boiling and cooling apparatus 2 will be described. Refrigerant vapor, boiled by heat from heat generating unit 3, rises in refrigerant chamber 7 and enters lower tank 13. The refrigerant vapor is dispersed in lower tank 13 and flows into the respective radiating tubes 16. The refrigerant vapor rising in the radiating tubes 16 is cooled by cooling air generated by the cooling fan 1 or a run wind generated from running of a vehicle. From this cooling air, radiation tubes radiate latent heat which condenses the refrigerant vapor.

The condensed liquid, condensed in the radiating tube 16, runs along the inner surface of the radiating tube 16 by gravity. After dropping into the lower tank 13 from the discharge tube 16, the liquid flows into the liquid return passage 8, and is circulated to the refrigerant chamber 7 through the connecting passage 10.

Next, advantages of the formation of the opening portion 23 in the casing 18 of the cooling fan 1 will be described. First, the relationship between ram air pressure and air movement of the run wind was measured when the opening portion 23 was bored into casing 18 and where the opening portion was not bored. Where the opening portion 23 is bored into casing 18, as described in the foregoing structure, the opening portion 23 is bored in both the wall surfaces 29 and 27 forming the stabilizer 20A at the intake side and the discharge side.

Figure 6:
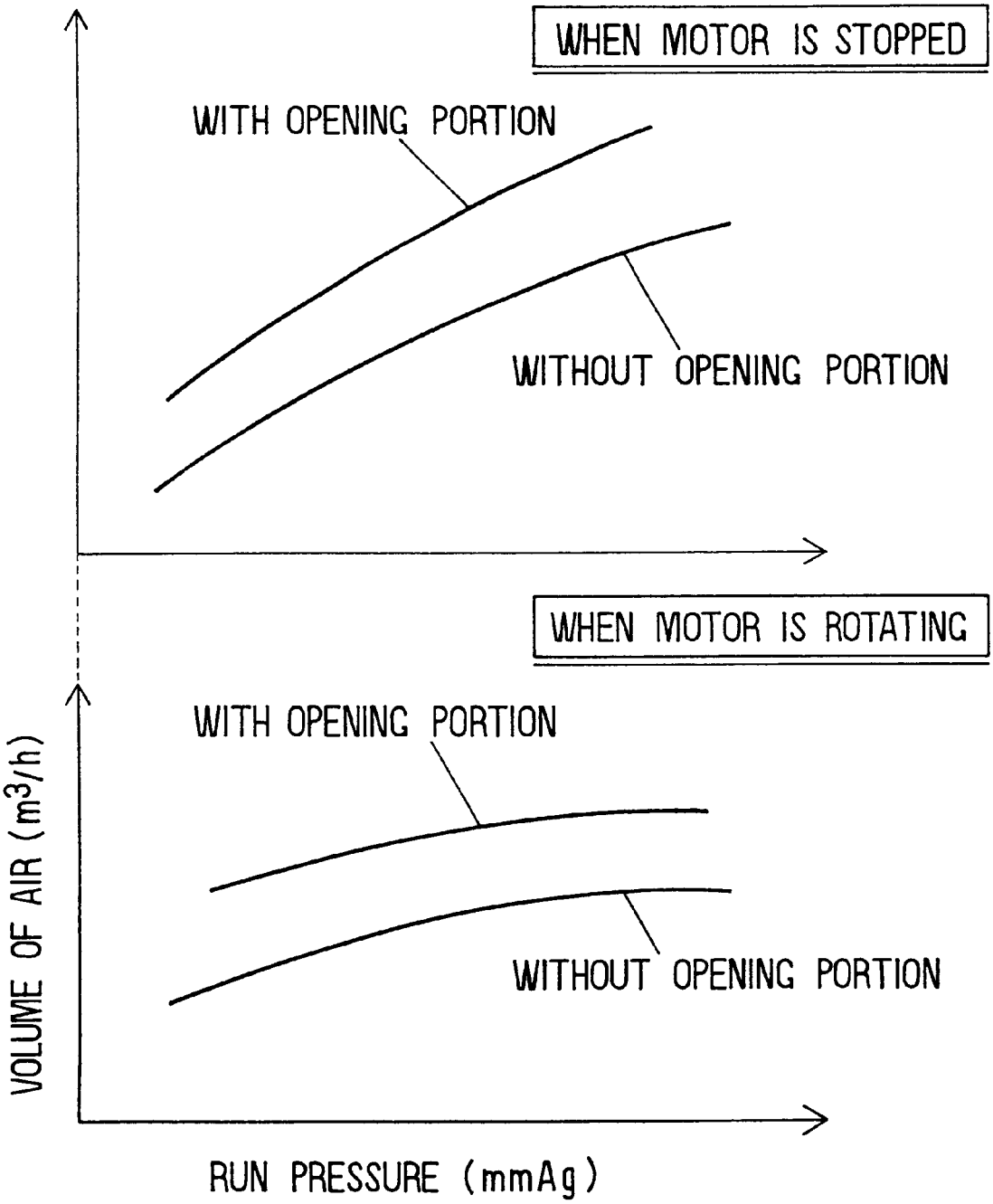
FIG. 6 is a graphical view illustrating the relationship between ram pressure and air volume for a cross-flow fan according to the present invention.

According to this measurement, as shown in FIG. 6, the result was such that the air movement increased in the case where the opening portions 23 were provided both when the motor was stopped and when the motor was rotating. It is considered that this result was obtained because by boring the opening portions 23 in the casing 18, ventilation resistance of the casing was lowered, and as a result, the air movement was increased.

Figure 7:
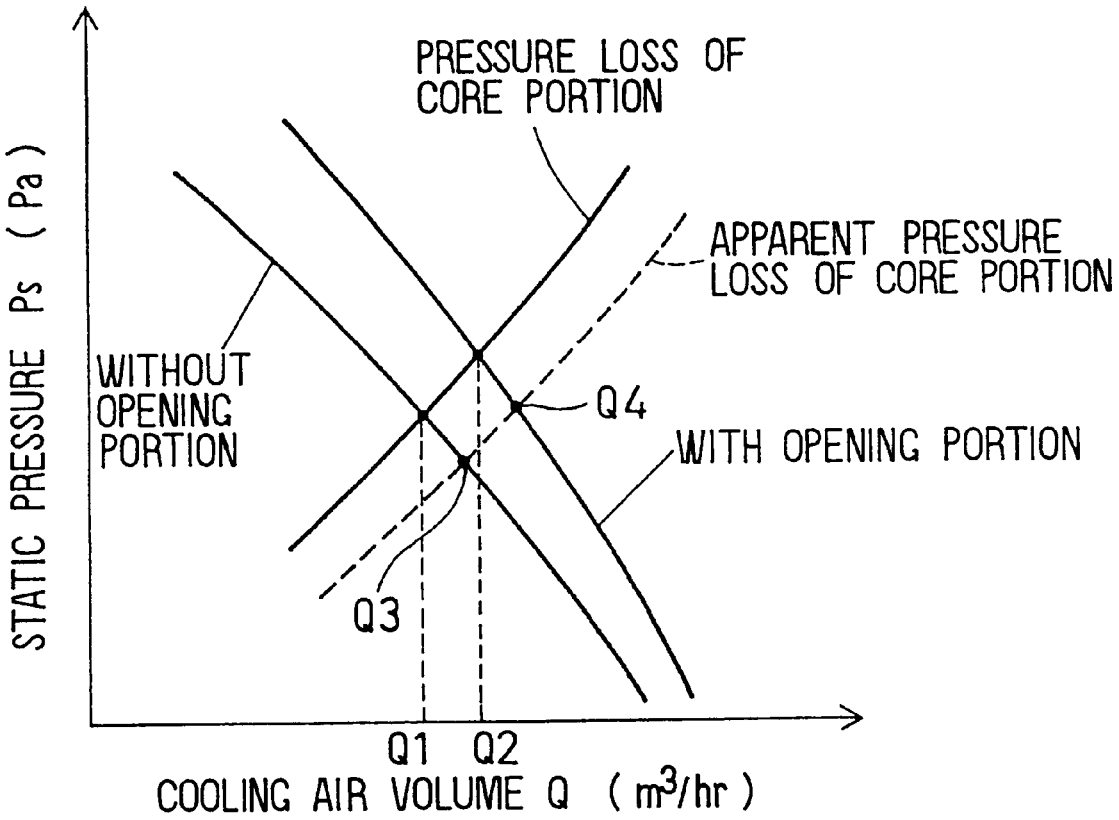
FIG. 7 is a graphical view illustrating the relationship between cooling air movement and static pressure for a cross-flow fan according to the present invention.

Subsequently, the relationship between the static pressure and the cooling air movement (static pressure—cooling air movement characteristics) generated by rotation of the bladed wheel 19 was measured where the opening portions 23 are bored in the casing 18 where the opening portion is not bored. The result is graphically illustrated in FIG. 7. Accordingly, at the same static pressure, the cooling air movement was larger when the opening portions 23 were bored in the casing 18 than when the opening portion 23 was not bored in the casing 18.

Then, where the run wind does not exist and where the opening portion 23 is not bored in casing 18, an air movement of value Q1 is generated due to the lower pressure beside the core portion 11. Where the opening portions 23 are bored in the casing 18, the air movement becomes Q2 (Q2>Q1) due to further pressure loss at the core portion 11. Thus, by boring the opening portions 23 in the casing 18, the cooling air movement is increased from Q1 to Q2. Therefore, when the vehicle is stopped and no run wind exists, the air volume flowing therethrough still is increased.

Where the run wind is generated, since the static pressure of the cooling fan 1 is lowered by the ram pressure, the apparent pressure loss of the core portion 11 is decreased. As a result, where the opening portion 23 is not bored in the casing 18, the air volume becomes Q3 (Q3>Q1) due to the apparent pressure loss of the core portion 11. Thus, the air volume is increased by Q3−Q1. Where the opening portions 23 are bored in the casing 18, the air volume becomes Q4 (Q4>Q2) due to the apparent pressure loss of the core portion 11. Thus, the air volume is increased by Q4−Q2. Here, when the increase of the air volume due to the run wind is compared when the opening portions 23 are bored in the casing 18 and when the opening portion is not bored, the following relation is obtained.

$$Q4-Q2>Q3-Q1$$

That is, where the opening portions 23 are bored in the casing 18, the increase of the air volume due to the run wind becomes larger.

In the cooling fan 1 of the first embodiment, since opening portions 23 are bored in both the wall surfaces 29 and 27. Even where the run wind does not exist (for example, in the state of idling), the air volume can be increased without raising the output of the motor. Where the cooling fan receives run wind and the opening portion 23 is not bored in the casing 18, the increase of air volume due to run wind becomes large. As a result, it is possible to effectively use the run wind and realize an increase of air movement. In other words, when the cooling air movement for ventilation of the core portion 11 is made equal to where the opening portion 23 is not bored in the casing 18, the output of the motor can be decreased. As a result, a smaller motor can be used. Moreover, noise is also reduced.

In the above measurement, even where run wind does not exist, the air volume of the fan was increased by boring the opening portions 23 in both wall surfaces 29 and 27. However, the fan characteristics are greatly changed according to the position where the opening portion 23 is bored. As a result, it is possible that the air movement of the fan might become lower than when opening portion 23 is not bored in casing 18. However, since it is possible to effectively use the run wind and to increase air movement by boring opening portion 23 in the casing 18, it is not always necessary to limit the positioning of the opening portions 23 to the two wall surfaces 29 and 27.

Figure 8A:
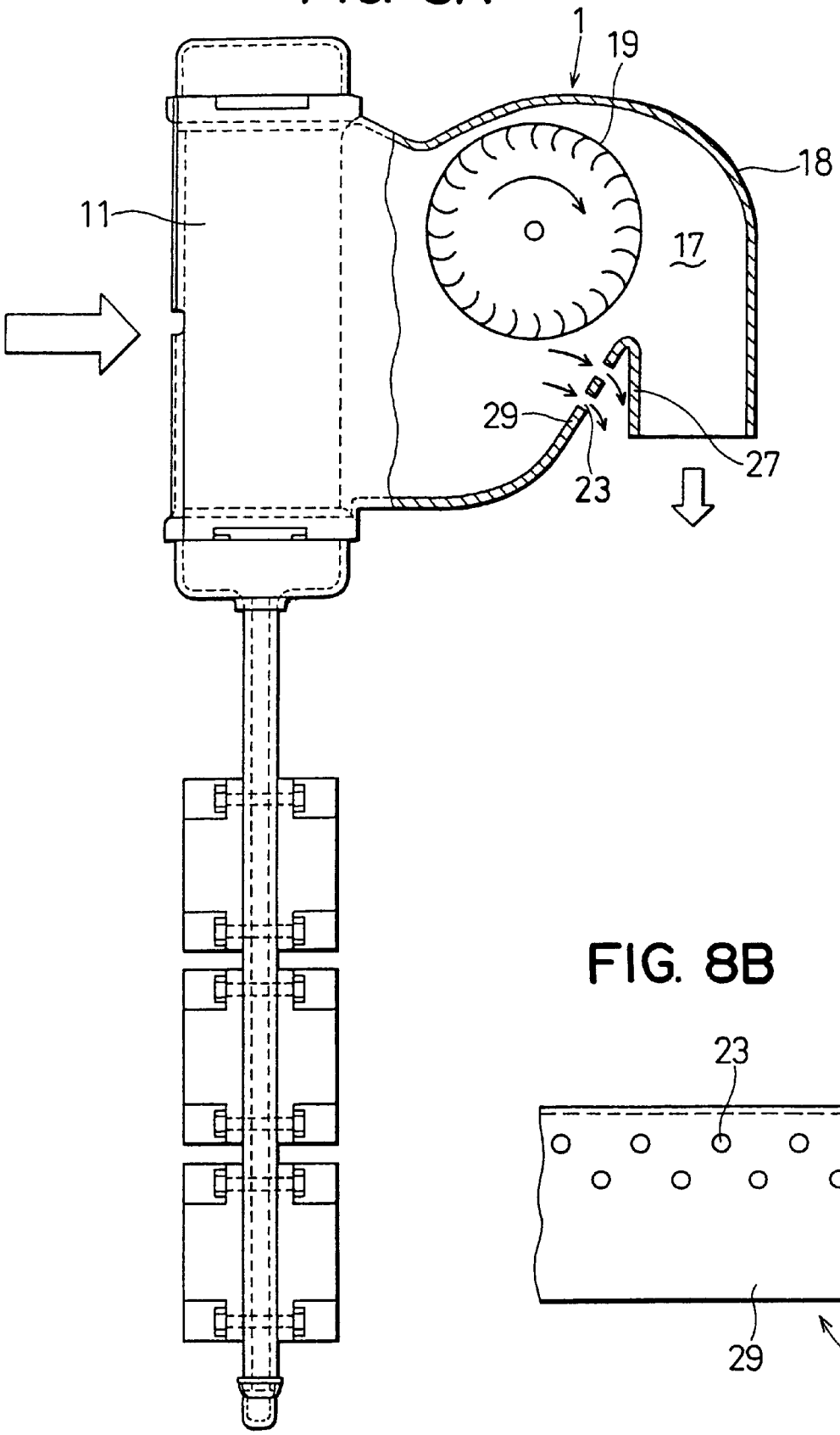
FIG. 8A is a side cross-sectional view illustrating a cross-flow fan according to a second embodiment of the present invention.
Figure 8B:
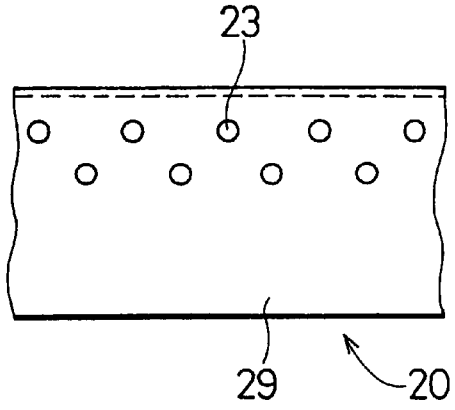
FIG. 8B is a partial cross-sectional view of a casing for a cross-flow fan according to the present invention.

As shown in FIG. 8A and 8B, a second embodiment of the present invention is shown and described. In this embodiment, the opening portion 23 is bored in only wall surface 29.

Figure 9:
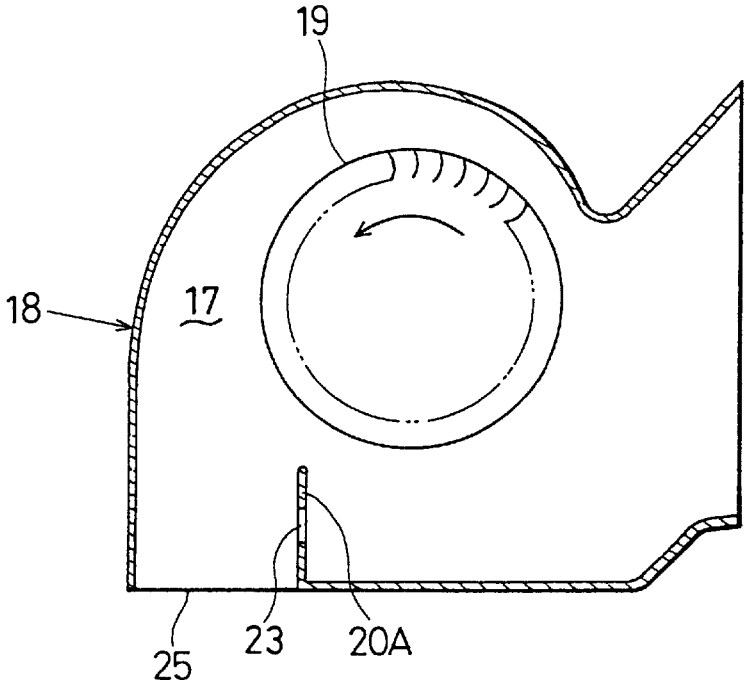
FIG. 9 is a cross-sectional view of a cross-flow fan according to a third embodiment of the present invention.

In FIG. 9, a third embodiment of the present invention is shown and described. In this embodiment, stabilizer 20A of casing 18 is made of one partition wall. The opening portion 23 is bored in the partition wall.

Figure 10:
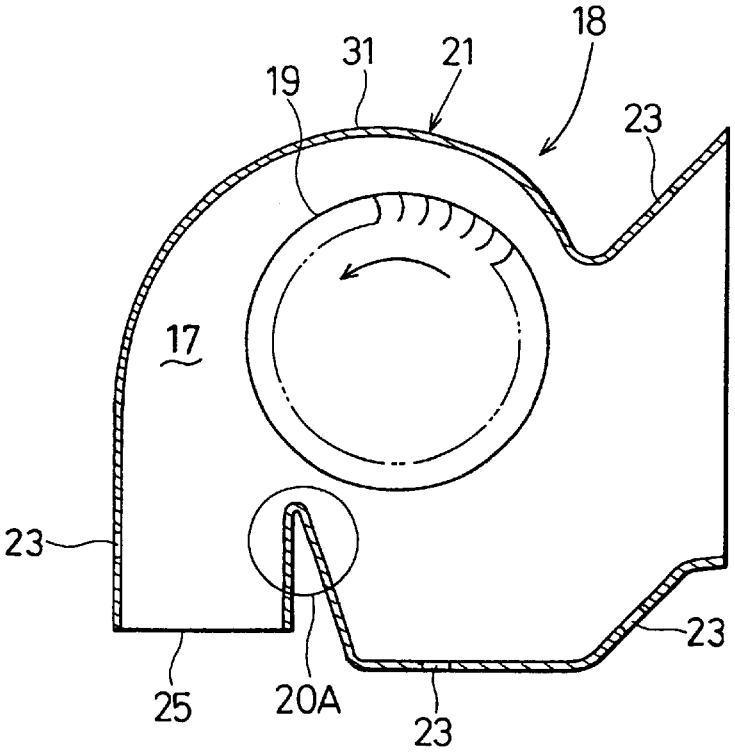
FIG. 10 is a cross-sectional view of a cross-flow fan according to a fourth embodiment of the present invention.
Figure 11:
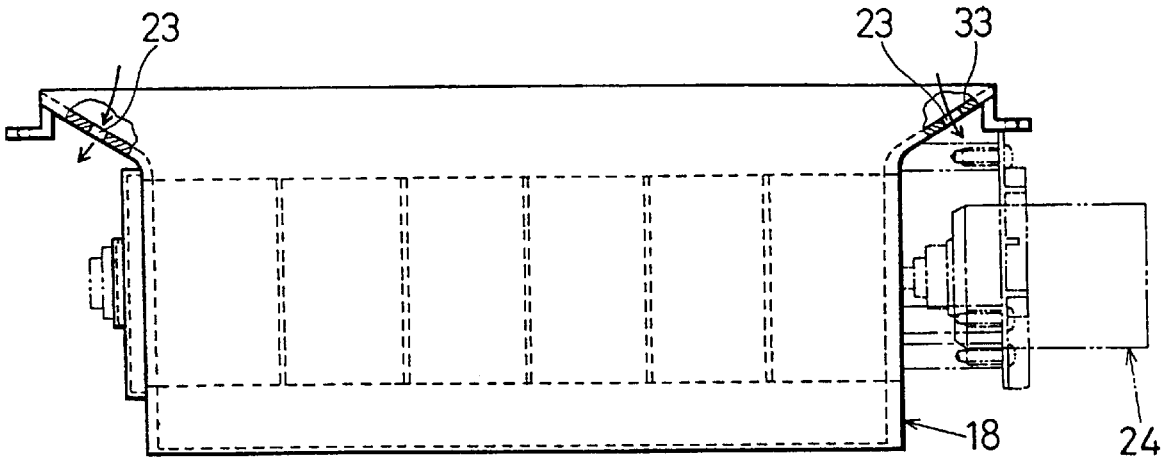
FIG. 11 is a top view of a cross-flow fan according to a fourth embodiment of the present invention.
Figure 12:
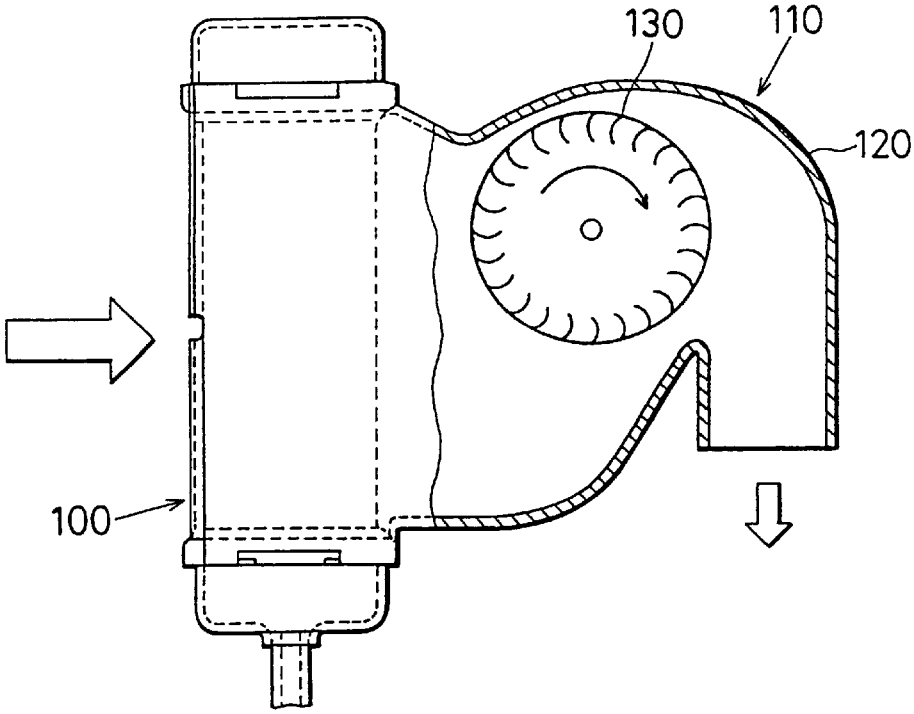
FIG. 12 PRIOR ART
FIG. 12 is a side view of a cross-flow fan according to the prior art.

In a fourth embodiment of the present invention, as shown in FIG. 10 and FIG. 11, the opening portion 23 is bored at a position other than on the wall surface forming the stabilizer 20A of the casing 18. In FIG. 10, although the opening portions 23 are shown bored at a plurality of places in the casing 18, this illustration shows only positions where the opening portions 23 can be bored. Thus, it is not necessary to bore the opening portions 23 at all these positions. Instead, the opening may be bored in only one place. However, preferable the scroll portion 31 of the outside wall surface 21 is excluded.

As shown in FIG. 11, where the opening portion 23 is bored into a slanted surface 33, which forms the intake port of the casing 18, air blown out from the opening portion 23 hits against motor 24. As a result, motor 24 is air-cooled.

In the cross-flow fan of the present invention, as described in the first embodiment, although the increase of air volume can be realized by using vehicle run wind, it is not always necessary to use the fan for a heat exchanger which is mounted in the vehicle and receives the run wind. Moreover, the heat exchanger using the cross-flow fan is not limited to the boiling and cooling apparatus 2 (core portion 11) shown in the first embodiment. Instead, the cross-flow fan can be used for various heat exchangers, for example, a heat exchanger for a freeze cycle, a heat exchanger used for a hot water circuit, or the like.

While the above-described embodiments refer to examples of usage of the present invention, it is understood that the present invention may be applied to other usage, modifications and variations of the same, and is not limited to the disclosure provided herein.

What is claimed is:

1. A cross-flow fan comprising:

a casing located at a downstream side of a heat exchanger and for forming an air passage;

a bladed wheel contained in the casing;

a motor for rotating and driving the bladed wheel; and air being sucked in the casing by rotation of the bladed wheel through the heat exchanger so that ventilation is made for the heat exchanger; wherein:

an opening portion for ventilation is bored in a wall surface of the casing; and the casing includes a partition portion for partitioning the air passage into an intake side and a discharge side, with a tongue portion close to an outer periphery of the bladed wheel as an apex, and the opening portion is bored in the wall surface forming this partition portion.

2. A cross-flow fan according to claim 1, wherein the partition portion is provided with roughly a mountain shape with the wall surface at the intake side and the wall surface at the discharge side joined at the tongue portion, and the opening portion is bored in either the wall surface at the intake side or the wall surface at the discharge side, or both surfaces.

3. A cross-flow fan according to claim 2, wherein the opening portions are bored in both the wall surface at the intake side and the wall surface at the discharge side forming the partition portion, and wherein the respective distances between the opening portions and a center of a swirl generated inside of the casing at a time of rotation of the bladed wheel are equal to each other.

4. A cross-flow fan according to claim 1, wherein the cross-flow fan is disposed at a vehicle's rear side with respect to the heat exchanger mounted in a vehicle, thus disposed at a position where a run wind generated from running of the vehicle blows against the heat exchanger, and the run wind passing through the heat exchanger is introduced into the inside of the casing.

5. A cross-flow fan comprising:

a casing located at a downstream side of a heat exchanger, said casing forming an air passage, said casing having a wall surface, said wall surface having a first opening portion allowing fluid communication between an outside of said casing and an inside of said casing, said first opening portion positioned at a position on said wall surface to lower ventilation resistance inside said casing;

a bladed wheel contained in the casing; and a motor engaged to said bladed wheel, wherein said motor rotationally drives the bladed wheel, wherein rotation of said bladed wheel causes air to be sucked into the casing through the heat exchanger; wherein:

said first opening portion facilitates flow of said air sucked through said heat exchanger; and the casing includes a partition portion for partitioning the air passage into an intake side and a discharge side, said partition portion having a tongue portion positioned close to an outer periphery of the bladed wheel, wherein the first opening portion is bored into the partition portion.

6. A cross-flow fan according to claim 5, wherein the partition portion has a wall surface at an intake side of said casing and the wall surface at a discharge side of said casing, said wall surface at said intake side being joined to said wall surface at said discharge side by said tongue portion.

7. A cross-flow fan according to claim 6, wherein said first opening portion is bored into the wall surface at the intake side.

8. A cross-flow fan according to claim 6, wherein said first opening portion is bored into the wall surface at the discharge side.

9. A cross-flow fan according to claim 6, wherein said first opening portion is bored into the wall surface at the discharge side, a second opening portion is bored into the wall surface at the intake side.

10. A cross-flow fan according to claim 9, wherein rotation of said bladed wheel causes said air to form a swirl formation inside said casing, wherein a first distance between the first opening portion and a center of the swirl and a second distance between the second opening portion and the center of the swirl are equal to each other.

* * * * *